US006608448B2

(12) United States Patent
Boer

(10) Patent No.: US 6,608,448 B2
(45) Date of Patent: Aug. 19, 2003

(54) ORGANIC LIGHT EMITTING DEVICE

(75) Inventor: Willem den Boer, Hillsboro, OR (US)

(73) Assignee: Planar Systems, Inc., Beaverton, OR (US)

( * ) Notice: Subject to any disclaimer, the term of this patent is extended or adjusted under 35 U.S.C. 154(b) by 0 days.

(21) Appl. No.: 09/773,397

(22) Filed: Jan. 31, 2001

(65) Prior Publication Data

US 2002/0101169 A1 Aug. 1, 2002

(51) Int. Cl.[7] ..... G09G 3/10; G09G 3/30

(52) U.S. Cl. ..... 315/169.3; 345/77

(58) Field of Search ..... 315/169.1, 169.3; 345/63, 76, 77

(56) References Cited

U.S. PATENT DOCUMENTS

| | | | | |
|---|---|---|---|---|
| 4,365,184 A | | 12/1982 | Higton et al. | 315/503 |
| 4,857,228 A | | 8/1989 | Kabay et al. | 252/301.45 |
| 5,844,368 A | | 12/1998 | Okuda et al. | 315/169.3 |
| 6,351,076 B1 | * | 2/2002 | Yoshida et al. | 315/169.1 |
| 6,351,255 B1 | * | 2/2002 | Ishizuka et al. | 345/77 |
| 6,369,515 B1 | * | 4/2002 | Okuda | 315/169.3 |
| 6,369,516 B1 | * | 4/2002 | Iketsu et al. | 315/169.3 |
| 6,369,786 B1 | * | 4/2002 | Suzuki | 345/77 |

* cited by examiner

*Primary Examiner*—Don Wong
*Assistant Examiner*—Minh D A
(74) *Attorney, Agent, or Firm*—Chernoff Vilhauer McClung & Stenzel, LLP

(57) ABSTRACT

An organic light emitting device with selected electrical energy potential imposed across the organic luminous material.

41 Claims, 7 Drawing Sheets

OLED current for drive scheme without reset on rows for current source drive of 20 and 60uA with a pixel capacitance of 5pF and column capacitance of 640 pF (128 rows x 5pF)

OLED current for reset drive scheme and current source drive of 20 and 60uA with a pixel capacitance of 5pF and column capacitance of 640pF (128 rows x 5pF)

ORGANIC LIGHT EMITTING DEVICE

BACKGROUND OF THE INVENTION

The present invention relates to an organic light emitting device, and in particular, to a drive scheme for an organic light emitting device.

Light emitting devices are becoming more popular as an image source in both direct view and virtual image displays. The popularity is due, at least in part, to the potential of generating relatively high luminance at relatively low power levels. For example, reflective liquid crystal displays can only be used in high ambient light conditions because they derive their light from the ambient light. Also, liquid crystal displays with back lights may be used in low ambient light conditions because they primarily derive their light from the back light. However, such liquid crystal displays are generally too large for practical use in very small devices.

Organic light emitting devices are especially suitable for use in very small devices, such as pagers, cellular and portable telephones, two-way radios, data banks, radios, etc. Organic light emitting devices are capable of generating sufficient light for use in displays under a variety of ambient light conditions, from no ambient light to high ambient light. Also, organic light emitting devices can be fabricated relatively cheaply and in a variety of sizes from very small (less than a tenth of a millimeter in diameter) to relatively large. In addition, light emitting devices have the added advantage that their emissive operation provides a very wide viewing angle.

Generally, organic light emitting devices include a first electrically conductive layer (or first contact), an electron transporting and emission layer, a hole transporting layer, and a second electrically conductive layer (or second contact). The light can be transmitted either way but typically exits through one of the conductive layers. There are many ways to modify one of the conductive layers for the emission of light there-through but it has been found generally that the most efficient light emitting device includes one conductive layer which is transparent to the light being emitted. Also, one of the most widely used conductive, transparent materials is indium-tin-oxide (ITO), which is generally deposited in a layer on a transparent substrate such as a glass plate.

Referring to FIG. 1, a conventional driving system for driving a luminous element is shown. The driving system shown in FIG. 1 is generally referred to as a simple matrix driving system in which anode lines $A_1$ through $A_m$ and cathode lines $B_1$ through $B_n$ are arranged in a matrix (grid). In the driving system shown in FIG. 1 luminous elements $E_{1,1}$ through $E_{m,n}$ are connected at each intersection of the anode lines and cathode lines. The driving system causes the luminous element at an arbitrary intersection to emit light by selecting and scanning one of the anode lines and the cathode lines sequentially at fixed time intervals and by driving the other of the anode and cathode lines by current sources $\mathbf{52}_1$ through $\mathbf{52}_m$, i.e., driving sources in synchronism with the scan.

Thus, there are traditionally two systems for driving luminous elements by means of the driving sources: (1) a system of scanning the cathode lines and driving the anode lines, and (2) a system of scanning the anode lines and driving the cathode lines. FIG. 1 illustrates the former case of scanning the cathode lines and driving the anode lines.

As shown in FIG. 1, the cathode line scanning circuit 51 is connected to the cathode lines $B_1$ through $B_n$ and the anode line driving circuit 52 comprising the current sources $\mathbf{52}_1$ through $\mathbf{52}_m$ is connected to the anode lines $A_1$ through $A_m$. The cathode line scanning circuit 51 applies a ground potential (0 volts) sequentially to the cathode lines $B_1$ through $B_n$ by scanning these lines while switching switches $\mathbf{53}_1$ through $\mathbf{53}_n$ to the side of a ground terminal at fixed time intervals. The anode line driving circuit 52 connects the current sources $\mathbf{52}_1$ through $\mathbf{52}_m$ with the anode lines $A_1$ through $A_m$ by controlling ON/OFF of switches $\mathbf{54}_1$ through $\mathbf{54}_m$ in synchronism with the scanning of the switches of the cathode line scanning circuit 51 to supply driving current to the luminous element at the desired intersection. In essence, a potential is imposed across or a current passed through the light emitting material.

When the luminous elements $E_{2,1}$ and $E_{3,1}$ are to emit light, for example, the switches $\mathbf{54}_2$ and $\mathbf{54}_3$ of the anode line driving circuit 52 are switched to the side of the current sources to connect the anode lines $A_2$ and $A_3$ with the current sources $\mathbf{52}_2$ and $\mathbf{52}_3$. At the same time the switch $\mathbf{53}_1$ of the cathode lines scanning circuit 51 is switched to the ground side so that the ground potential is applied to the first anode line $B_1$. The luminous elements are controlled so that the luminous element at an arbitrary position emits light and so that each luminous element appears to emit light concurrently by quickly repeating such scan and drive.

A reverse bias voltage $V_{cc}$, which is equal to the source voltage, is applied to each of the cathode lines $B_2$ through $B_n$. The reverse bias voltage $V_{cc}$ is not applied to the cathode line $B_1$ being scanned in order to prevent erroneous emission. It should be noted that although the current sources $\mathbf{52}_1$ through $\mathbf{52}_m$ are used as the driving sources in FIG. 1, the same effect may be realized also by using voltage sources.

Each of the luminous elements $E_{1,1}$ through $E_{m,n}$ connected at each intersection may be represented by a luminous element E having a diode characteristic and a parasitic capacitor C connected in parallel, as shown by the equivalent circuit in FIG. 2. Traditional driving systems described above have had problems due to the parasitic capacitor C within the equivalent circuit. The problems are described as follows.

FIGS. 3A and 3B illustrate each of the luminous elements $E_{1,1}$ through $E_{1,n}$ using only the parasitic capacitors C described above by excerpting the part of the luminous elements $E_{1,1}$ through $E_{1,n}$ connected to the anode line $A_1$ in FIG. 1. When the cathode line $B_1$ is scanned and the anode line $A_1$ is not driven, the parasitic capacitors $C_{1,2}$ through $C_{1,n}$ of the other luminous elements $E_{1,2}$ through $E_{1,n}$ (except the parasitic capacitor $C_{1,1}$ of the luminous element $E_{1,1}$ connected to the cathode line $B_1$ currently being scanned), are charged by the reverse bias voltage $V_{cc}$ applied to each of the cathode lines $B_1$ through $B_n$, in the direction as shown in FIG. 3A.

Next, when the scanning position is shifted from the cathode line $B_1$ to the next cathode line $B_2$ and the anode line $A_1$ is driven in order to cause the luminous element $E_{1,2}$ to emit light, for example, the state of the circuit is shown in FIG. 3B. Thus, not only is the parasitic capacitor $C_{1,2}$ of the luminous element $E_{1,2}$, which emits light changed, but the parasitic capacitors $C_{1,1}$ and $C_{1,3}$ through $C_{1,n}$ of the luminous elements $E_{1,1}$ and $E_{1,3}$ through $E_{1,n}$ connected to the other cathode lines $B_1$ and $B_3$ through $B_n$, also are charged because currents flow into the capacitors in the direction as indicated by arrows.

In general, luminous elements can not emit light normally unless a voltage between both ends thereof builds up to a level which exceeds a specified value. In the traditional driving system, not only is the parasitic capacitor $C_{1,2}$ changed when $E_{1,2}$ is to emit light, but the parasitic capacitors $C_{1,3}$ through $C_{1,n}$ of the other luminous elements $E_{1,3}$ through $E_{1,n}$ are charged as well. As a result, the end-to-end voltage of the luminous element $E_{1,2}$ connected to the cathode line $B_2$ can not build up above the specified value until the charging of all of these parasitic capacitors of the luminous elements is completed.

Accordingly, such a system has the limitation that the build up speed until emission is slow. Also no fast scan can be attained due to the parasitic capacitors described above. Further, because the parasitic capacitors of all the luminous elements connected to the anode line have to be charged, the current capacity of the driving source for driving the luminous elements connected to each anode line must be large. The aforementioned problems become more significant as the number of luminous elements increase.

Okuda et al., U.S. Pat. No. 5,844,368, disclose an improved driving system for an organic light emitting device in which all cathode lines and all anode lines are reset by dropping their voltage to a ground potential once in a shifting scan to the next cathode line. Similarly, Okuda et al. likewise disclose a driving system that corresponds to a case when all of the cathode lines and anode lines are reset once to the source voltage $V_{cc}$ before the next cathode line is scanned. Further, Okuda et al. disclose a driving system that corresponds to a case when all of the cathode lines are reset to $V_{cc}$ and the anode lines are preset, in order to be ready for the next emission before the next cathode line is scanned.

DETAILED DESCRIPTION OF THE PREFERRED EMBODIMENT

The present inventor attempted to implement a traditional gray scale technique for the organic light emitting device by varying the current levels or the width of the pulse imposed on different the column electrodes in accordance with the gray level desired. To the present inventor's surprise the resulting gray levels were simply unacceptable. In general, the gray levels tended to be compressed within a limited range of current levels from the column drivers, shifted at different dimming levels, varied from display to display, varied with changing temperature, and undergo differential aging over time. In light of these difficulties in achieving acceptable gray scale performance, a detailed analysis of the characteristics of an organic light emitting display was undertaken. In general, gray levels are achieved by pulse width modulation of the current through the pixels. In general, dimming is achieved by adjusting the current level passing through the pixels.

Figure 1:
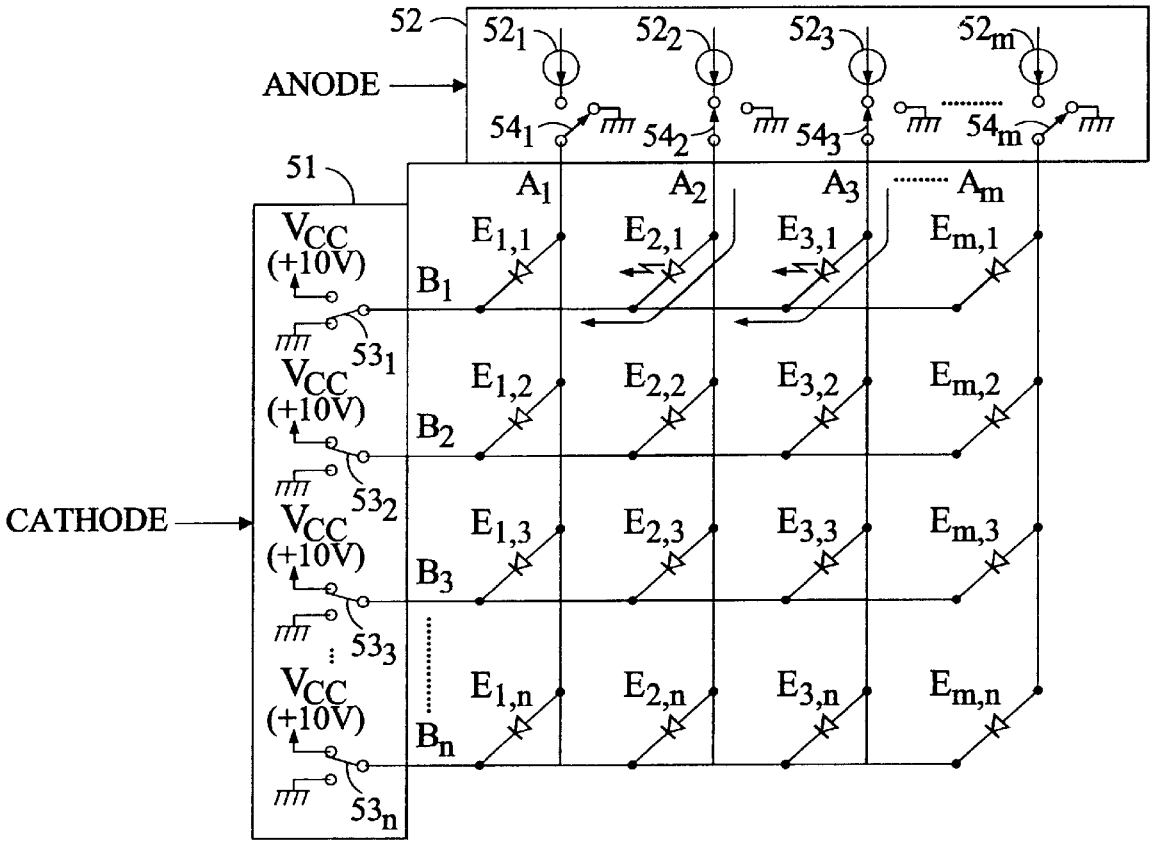
FIG. 1 illustrates a prior art driving system for an organic light emitting device.
Figure 2:
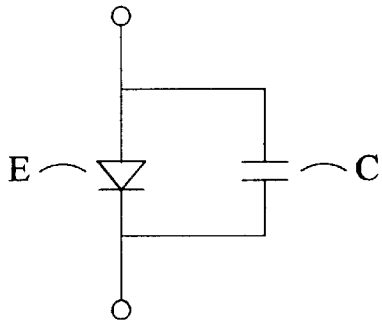
FIG. 2 illustrates an equivalent circuit of a luminous element for an organic light emitting device.
Figure 3A:
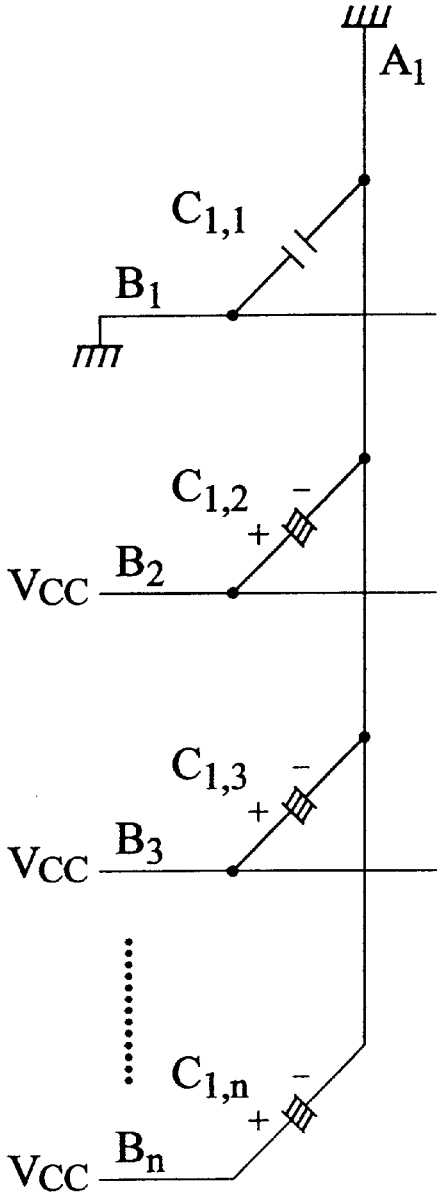
FIGS. 3A and 3B illustrate charging/discharging states in shifting scans in the prior art driving system.
Figure 3B:
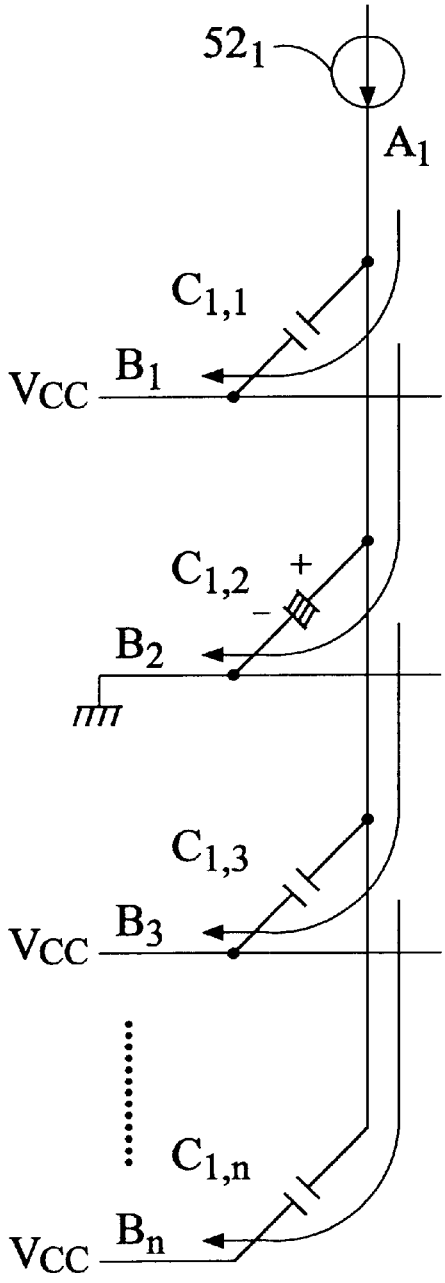
Figure 4:
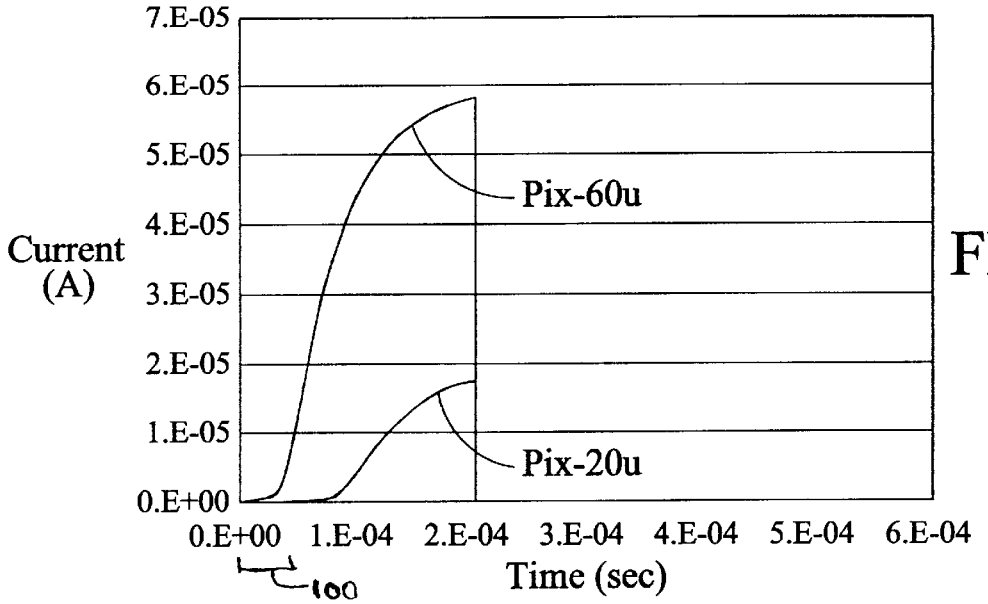
FIG. 4 is a graph of an organic light emitting device current for a drive scheme without reset of rows.

In an attempt to understand this unanticipated phenomena an organic light emitting device was simulated. Referring to FIG. 4, a graph of the current through the pixel verus time for different current levels for a traditional drive technique (without reset on the rows) revealed potential limitations. Initially, there is a delay 100 before any significant current starts to pass through the pixels, which decreases the time available for the gray levels during a line time. In addition, this delay 100 further varies based upon the current provided by the column drivers and the column capacitance, or otherwise passing through the pixels. For example, 20 $\mu$-amps from the column drivers results in a greater delay 100 than 60 $\mu$-amps from the column drivers. The changes in the delay 100 at different current levels makes it difficult to achieve accurate gray levels, especially if dimming of the device is performed. At the lower current levels, such as 20 $\mu$-amps, there is little, if any, illumination. Moreover, the curve profiles of the pixel currents varies at different dimming levels further exasperating the ability to achieve accurate gray levels. To further complicate the ability to provide an accurate set of gray levels, the current-voltage profile of the "diode" characteristics of the device age (changes after extended use). Further, achieving an accurate gray scale is likewise complicated by pixels aging non-uniformly over time based on differential use, different luminance characteristics exist between different displays, and the luminance characteristics of the device vary with temperature.

Figure 5:
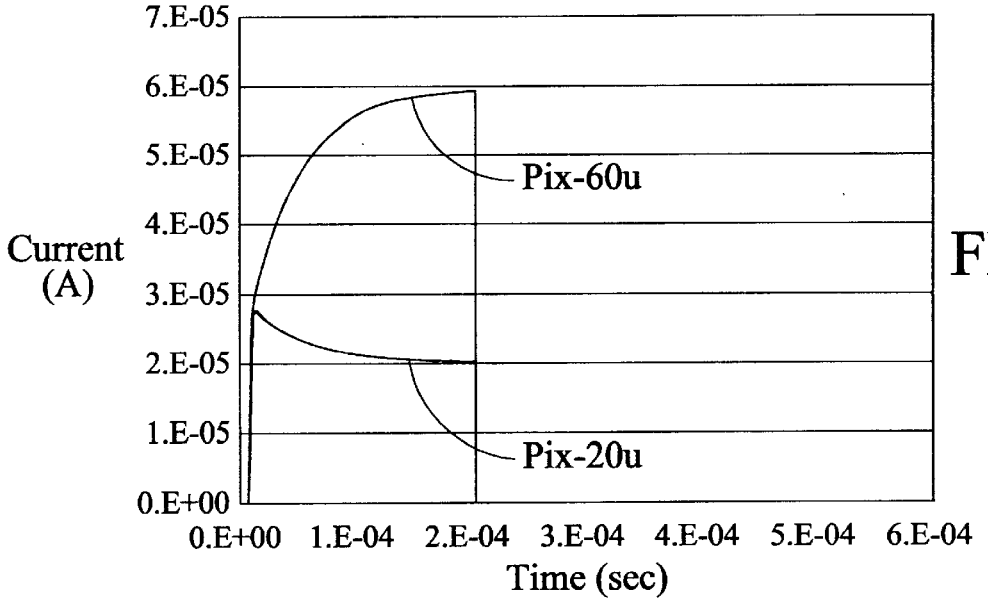
FIG. 5 is a graph of an organic light emitting device current for a drive scheme with reset functionality.

Referring to FIG. 5, a graph of the current through the pixel versus time for different current levels, for a modified drive technique including the reset pulse, likewise reveals potential limitations. The upper portion of FIG. 5 shows that at higher current levels through the pixels an increasingly greater luminance emission occurs. The maximum available luminance at the higher current levels within a predefined time period is limited by the significant time required to reach substantially maximum luminance output. Further, the luminance profile at higher current levels is likewise non-uniform and non-linear which further limits the ability to achieve an accurate gray scale. Referring to the lower portion of FIG. 5, at lower current levels the luminance output from the pixels includes a significant overshoot and thereafter significantly decreases in luminance emission. This overshoot makes implementing low luminance gray levels difficult, because of the unavoidable excess light resulting from the overshoot. Further, it is difficult to achieve a sufficiently dim gray level because of light output from the overshoot. In general, a voltage is imposed across the pixels which results in an initial luminance output from the respective pixel which thereafter tends to increase or decrease depending on the voltage imposed. This non-uniform luminance makes it especially difficult to design an effective gray scale, especially one having a significant number of different levels, from dim to bright, i.e., having the same gamma for different dimming levels.

Figure 6:
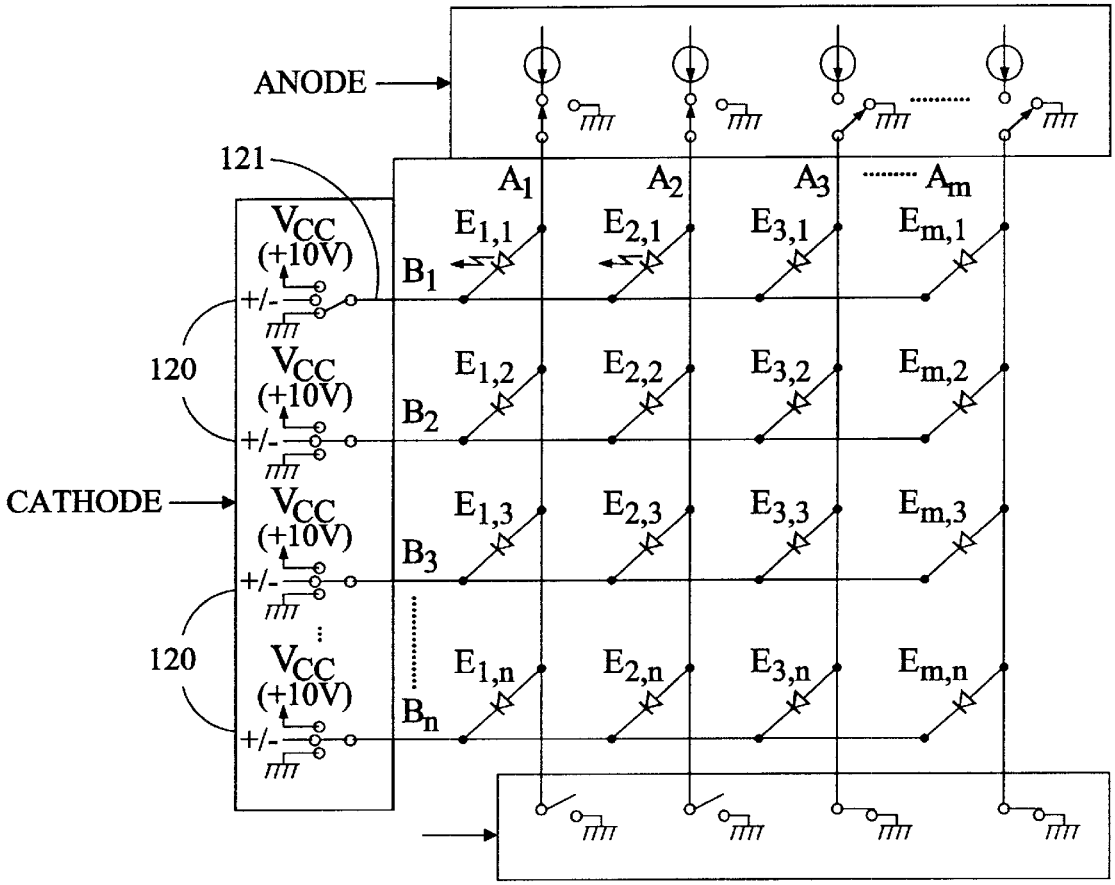
FIG. 6 illustrates a driving system for an organic light emitting device.

After further consideration of the difficulties of implementing a gray scale with the aforementioned techniques, the present inventor came to the startling realization that a suitable selection of the voltage of the non-scanning electrodes, such as the row voltages, may result in substantially uniform luminance output during a major portion of the line-time. Referring to FIG. 6, for the reset pulse architecture, this may by accomplished by providing a non-zero ground voltage 120 having a suitable value to the non-scanned row electrodes. The scanned row electrode 121 is set to a different voltage than the non-scanned electrodes, such as for example, ground. In essence, the non-zero charge on the non-scanned row electrode may be suitably set to provide more desirable output luminance characteristics, especially suitable for multiple gray levels. In addition, it may be observed that the overshoot is substantially eliminated by proper voltage selection. Normally the selected non-scanned row voltages are between ground and Vcc.

Figure 7:
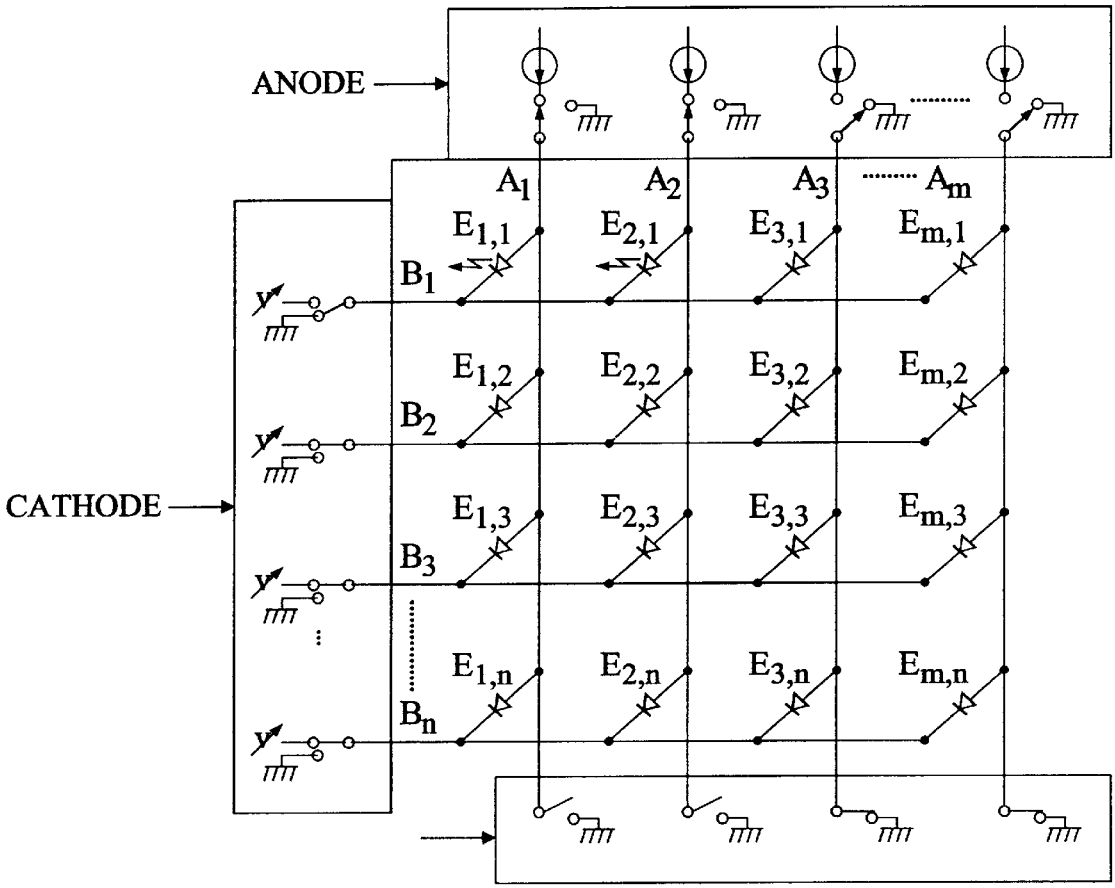
FIG. 7 illustrates another driving system for an organic light emitting device.

While the selection of a non-Vcc row voltage provides an improvement to existing drive techniques, especially when attempting to implement a gray scale display, the present inventor came to the further realization that at different dimming levels (e.g., different current/voltage levels from the column drivers) the selection of a non-Vcc non-scanned row voltage (charge imposed on the row electrodes) does not provide the optimum results. Accordingly, at different column current/voltage levels provided by the column drivers the present inventor determined that the non-scanned (non-selected) row voltages should be modified in some manner so as to provide a substantially uniform luminance output during a major portion of the line-time, as shown in FIG. 7. In addition, it may be observed that the overshoot is substantially eliminated. Normally the non-selected row voltage is between ground and Vcc (power supply voltage), and is lower at lower dimming levels.

In general, the capacitive charge of each pixel of a selected electrode is charged to a suitable level prior to or simultaneously with the illumination of the pixels.

Figure 8A:
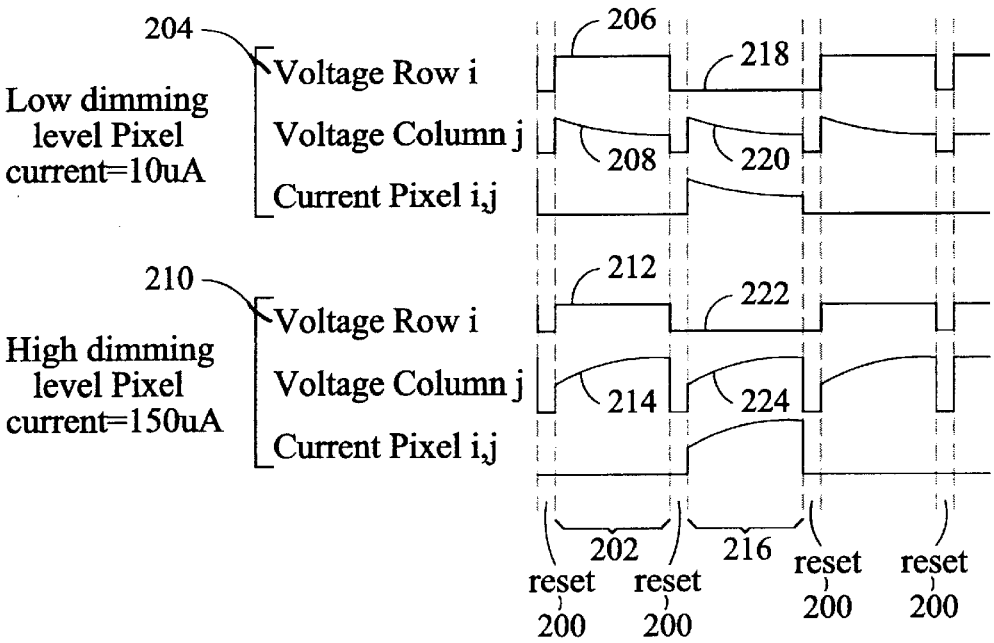
FIGS. 8A and 8B illustrate the resulting waveform from the driving system with and without non-select voltage adjustment.

Referring to FIG. 8A, for purposes of illustration, some existing techniques reset the row and column voltages during a reset time period 200 to ground. During the line time 202, the voltage row i 204 of the low dimming level is set to Vcc 206 which results in an overshoot of the voltage of column j 208. The voltage of column j 208 then settles to a lower voltage, such as the resulting voltage imposed by the column drivers (which normally are current drivers). Similarly, during the line time 202, the voltage row i 210 of the high dimming level is set to Vcc 212 which results in an increasing voltage of column j 214. In either case, the respective pixel is not illuminated because the voltage on the row i 206, 212 is higher than the respective voltage on the column. Accordingly, no significant current will pass through the luminous element.

During the line time 216, the voltage row i 204 of the low dimming level is set to ground 218, which likewise results in an overshoot of the voltage of column j 220. The voltage of column j 220 then settles to a lower voltage, such as the resulting voltage imposed by the column drivers (which normally are current drivers). Similarly, during the line time 216, the voltage row i 210 of the high dimming level is set to ground 222 which results in an increasing voltage of column j 224. In either case, the respective pixel is illuminated because the voltage on the row i 218, 222 is sufficiently low in comparison to the voltage resulting on the columns.

Figure 8B:
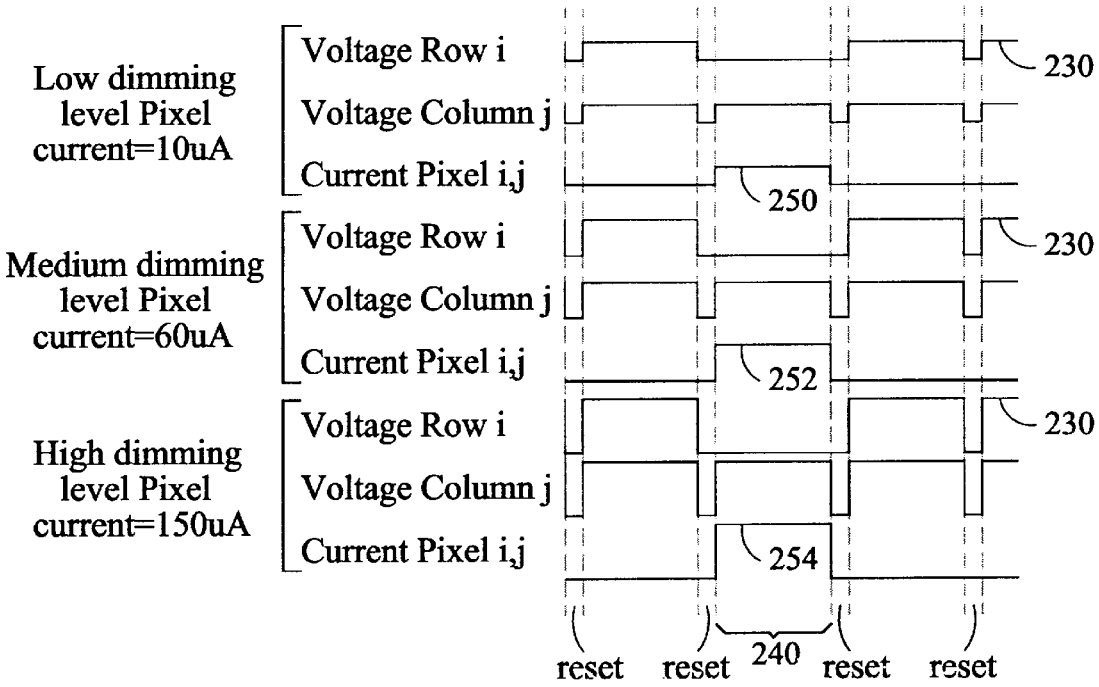

Referring to FIG. 8B, for purposes of illustration, in one embodiment the non-select row voltage level 230 is adjusted in accordance with the respective column voltages at each of the selected dimming levels. In a preferred embodiment, the voltage imposed on both the non-selected rows and the columns, as determined by the applied current level from the column drivers, are preferably substantially the same. When the initially imposed voltages on both sides of the organic light emitting material are substantially the same, then there is no significant time delay previously required for charging the columns (e.g., in the case of higher dimming levels) or no significant time delay previously required for discharging the columns (e.e., in the case of lower dimming levels). As may be observed, the resulting pixel illumination 250, 252, and 254 is substantially uniform. In addition, it is to be understood that these techniques may likewise be applied to driving schemes that do not include a reset pulse. In essence, a suitable charge is imposed across the row pixels prior to, or simultaneously with, the driving of the column electrodes. It is to be understood that the designation of columns, rows, anode, and cathode is merely for purposes of discussion. In addition, any arrangement of the electrodes or alignment may be used, as desired. Likewise, the luminance output of the pixels preferably include one or more of the following properties, (1) without a substantial overshoot in luminance, (2) substantially uniform luminance during a major portion of the line time, and (3) substantially uniform luminance during substantially all, 70% of, 80% of, or 90% of the line time.

Figure 9:
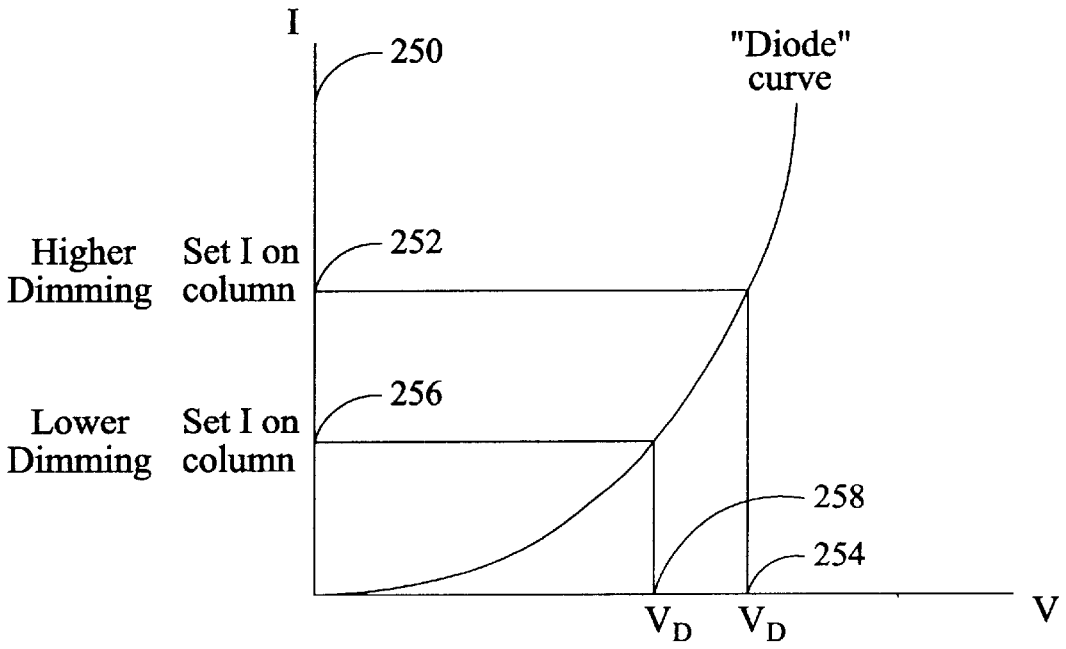
FIG. 9 illustrates diode characteristics of the display and selected voltages

Referring to FIG. 9, the particular row voltages and resulting column voltages from the column current drivers, are preferably selected in relation to the diode curve characteristics of the device. The current is selected for a column electrode, as illustrated on the vertical axis 250. The current level, for example a high dimming level 252, results in an imposed voltage 254 on the respective column. The current level, for example a low dimming level 256, results in an imposed voltage 258 on the respective column. The voltage level 254 is greater than the voltage level 258. Depending on the dimming level 252, 256 the resulting voltage levels on the columns will change accordingly. Based on the previous discussion, the non-selected row voltages are likewise preferably selected in accordance with the resulting voltage levels on the columns so that insignificant capacitive losses will result.

What is claimed is:

1. An organic light emitting device comprising:

(a) a plurality of first electrodes;

(b) a plurality of second electrodes at least partially intersecting said first plurality of said first electrodes;

(c) an organic luminous element being coupled to at least one of said first electrodes and to at least one of said second electrodes at a location proximate where said at least one of said first electrodes and said at least one of said second electrodes intersect; and (d) a control mechanism suitable to illuminate said organic luminous element by providing electrical energy to said organic luminous element in a manner that said illumination from said organic luminous element is substantially uniform for a major portion of the duration that said electrical energy causes said illumination.

2. The device of claim 1 wherein said first and second electrodes are arranged in a matrix.

3. The device of claim 1 wherein said first electrode is set to a voltage less than the power supply voltage to the driver of the said first electrode when not being scanned.

4. The device of claim 3 wherein a scanned said first electrode is set to a voltage potential less than a voltage potential of another non-scanned first electrode when said organic luminous element associated with said scanned first electrode is illuminated.

5. The device of claim 1 wherein said illumination is free from any substantial overshoot.

6. The device of claim 1 wherein a different electrical energy level is provided to at least one of said first electrodes in accordance with a different electrical energy level provided to at least one of said second electrodes.

7. The device of claim 1 wherein a charge imposed on at least one of said first electrodes is maintained substantially uniform during a major portion of the duration of said illumination.

8. The device of claim 1 wherein a first charge level is imposed on one of said first electrodes, a second charge level is imposed on the remainder of said first electrodes, and said second charge level is imposed on at least one of said second electrodes.

9. The device of claim 8 wherein said first charge level is ground.

10. An organic light emitting device comprising:

(a) a plurality of first electrodes;

(b) a plurality of second electrodes, each of which at least partially intersects a plurality of said first electrodes;

(c) respective organic luminous elements being coupled to respective ones of said first electrodes and to respective ones of said second electrodes at a location proximate where respective ones of said first electrodes and respective said respective ones of said second electrodes intersect; and (d) a control mechanism for causing at least one of said luminous elements to emit light by imposing a first electrical energy to a first one of said first electrodes while selectively providing electrical energy to selected ones of said plurality of second electrodes and simultaneously causing a plurality of said luminous elements associated with another one of said first electrodes to be free from emitting light by imposing a second electrical energy on said another first electrode in a manner that the charge initially imposed on opposing sides of said luminous elements free from emitting light are substantially equal.

11. The device of claim 10 wherein said control mechanism is suitable to illuminate said organic luminous element by imposing an electrical charge across said organic luminous element in a manner that said illumination from said organic luminous element is substantially uniform for a major portion of the duration that said electrical charge causes said illumination.

12. The device of claim 10 wherein said first and second electrodes are arranged in a matrix.

13. The device of claim 10 wherein at least one of said first electrodes is set to a charge potential less than the supply voltage to the drivers when not being scanned and at least one pixel of said device is illuminated.

14. The device of claim 10 wherein at least one of said first electrodes is set to a zero voltage potential when said organic luminous elements are illuminated.

15. The device of claim 10 wherein said illumination is free from any substantial overshoot.

16. The device of claim 10 wherein a different electrical energy level is provided to at least one of said first electrodes in accordance with a different electrical energy level provided to at least one of said second electrodes.

17. The device of claim 10 wherein a charge imposed on a plurality of said first electrodes not corresponding with illuminated said elements is maintained substantially uniform during a major portion of the duration of said illumination.

18. The device of claim 10 wherein a first charge is imposed on one of said first electrodes and a second charge, greater than said first charge, is imposed on the remaining said first electrodes.

19. The device of claim 18 wherein said first charge is selected in relation to the diode curve characteristics of said device.

20. An organic light emitting device comprising:

(a) a plurality of first electrodes;

(b) a plurality of second electrodes at least partially intersecting said first plurality of said first electrodes;

(c) an organic luminous element being coupled to at least one of said first electrodes and to at least one of said second electrodes at a location proximate where said at least one of said first electrodes and said at least one of said second electrodes intersect; and (d) a control mechanism suitable to illuminate said organic luminous element by providing electrical energy to said organic luminous element in a manner that said illumination from said organic luminous element is free from any substantial undershoot and overshoot during initial said illumination.

21. The device of claim 20 wherein said first and second electrodes are arranged in a matrix.

22. The device of claim 20 wherein said first electrode is set to a voltage less than the power supply voltage to the driver of the said first electrode when not being scanned.

23. The device of claim 20 wherein a scanned said first electrode is set to a voltage potential less than a voltage potential of another non-scanned first electrode when said organic luminous element associated with said scanned first electrode is illuminated.

24. The device of claim 20 wherein said illumination from said organic luminous element is substantially uniform for a major portion of the duration that said electrical energy causes said illumination.

25. The device of claim 20 wherein a different electrical energy level is provided to at lest one of said first electrodes in accordance with a different electrical energy level provided to at least one of said second electrodes.

26. The device of claim 20 wherein a charge imposed on at least one of said first electrodes is maintained substantially uniform during a major portion of the duration of said illumination.

27. The device of claim 20 wherein a first charge level is imposed on one of said first electrodes, a second charge level is imposed on the remainder of said first electrodes, and said second charge level is imposed on at lest one of said first electrodes.

28. The device of claim 27 wherein said first charge is ground.

29. An organic light emitting device comprising:

(a) a plurality of first electrodes;

(b) a plurality of second electrodes at least partially intersecting said first plurality of said first electrodes;

(c) a first organic luminous element being coupled to at least one of said first electrodes and to at least one of said second electrodes at a location proximate where said at least one of said first electrodes and said at least one of said second electrode intersect;

(d) a second organic luminous element being coupled to at least another one of said first electrodes and to at least one of said second electrodes at a location proximate where said at least another one of said first electrodes and said at least one of said second electrode intersect;

(e) a control mechanism suitable to illuminate said first organic luminous element by providing electrical energy to said first organic luminous element in a manner that said first organic luminous element is illuminated illumination from said first organic luminous element is free from any substantial undershoot and overshoot during initial said illumination; and (f) said control mechanism suitable to simultaneously maintain said second organic luminous element from illumination by providing electrical energy to both sides of said second organic luminous element in in a manner that the charge on both sides of said second organic luminous element, substantially when said first organic luminous element is illuminated, is substantially equal.

30. The device of claim 29 wherein said first and second electrodes are arranged in a matrix.

31. The device of claim 29 wherein said first electrode is set to a voltage less than the power supply voltage to the driver of the said first electrode when not being scanned.

32. The device of claim 29 wherein a scanned said first electrode is set to a voltage potential less than a voltage potential of another non-scanned first electrode when said first luminous element associated with said scanned first electrode is illuminated.

33. The device of claim 29 wherein said illumination from said first organic luminous element is substantially uniform for a major portion of the duration that said electrical energy causes said illumination.

34. The device of claim 29 wherein a different electrical energy level is provided to at lest one of said first electrodes in accordance with a different electrical energy level provided to at least one of said second electrodes.

35. The device of claim 29 wherein a charge imposed on at least one of said first electrodes is maintained substantially uniform during a major portion of the duration of said illumination.

36. The device of claim 29 wherein a first charge level is imposed on one of said first electrodes, a second charge level is imposed on the remainder of said first electrodes, and said second charge level is imposed on at lest one of said first electrodes.

37. The device of claim 36 wherein said first charge is ground.

38. An organic light emitting device comprising:

(a) an organic luminous element interposed between a first electrode and a second electrode;

(b) a control mechanism suitable to illuminate said organic luminous element by providing electrical energy to said organic luminous element in a manner that said illumination from said organic luminous element is substantially uniform during a major portion of said illumination.

39. The device of claim 38 wherein said illumination is substantially uniform during at least 70% of said illumination.

40. The device of claim 38 wherein said illumination is substantially uniform during at least 90% of said illumination.

41. The device of claim 38 wherein said illumination is substantially uniform during at least 80% of said illumination.

* * * * *

UNITED STATES PATENT AND TRADEMARK OFFICE

CERTIFICATE OF CORRECTION

PATENT NO. : 6,608,448 B2
DATED : August 19, 2003
INVENTOR(S) : Boer

It is certified that error appears in the above-identified patent and that said Letters Patent is hereby corrected as shown below:

Column 4,
Line 9, change “pixel verus time” to -- pixel versus time --

Column 6,
Line 5, change “(e.e., in” to -- (e.g., in --

Column 8,
Lines 35 and 45, change “at lest one” to -- at least one --

Column 9,
Line 7, change “element in in a” to -- element in a --
Line 9, change “at lest one” to -- at least one --

Column 10,
Line 4, change “at lest one” to -- at least one --

Signed and Sealed this

Fifteenth Day of March, 2005

JON W. DUDAS
*Director of the United States Patent and Trademark Office*